US005464192A

United States Patent [19]

Burnham

[11] Patent Number: 5,464,192

[45] Date of Patent: Nov. 7, 1995

[54] HIGH SPEED MANUAL POST PULLER

[76] Inventor: Dale A. Burnham, Rte. 5, Box 834-D, Waco, Tex. 76705

[21] Appl. No.: 296,459

[22] Filed: Aug. 26, 1994

[51] Int. Cl.[6] ..... E21B 19/00

[52] U.S. Cl. ..... 254/30

[58] Field of Search ..... 254/29 R, 30, 254/31, 132, DIG. 1, 129, 130, 131, 120

[56] References Cited

U.S. PATENT DOCUMENTS

| | | | |
|---|---|---|---|
| D. 300,801 | 4/1989 | Pollard | D8/51 |
| 475,764 | 5/1892 | Garren | 254/130 |
| 580,737 | 4/1897 | Smith | 254/31 |
| 1,761,675 | 6/1930 | Mick | 254/132 |
| 1,911,287 | 5/1933 | Pladson | 254/132 |
| 3,525,502 | 8/1970 | Fisher | 254/30 |
| 4,422,621 | 12/1983 | Ekern | 254/30 |
| 4,706,935 | 11/1987 | Thompson | 254/29 R |
| 4,726,565 | 2/1988 | Keller | 254/30 |
| 4,738,433 | 4/1988 | Hoff | 254/30 |
| 5,186,437 | 2/1993 | Scott | 254/30 |

FOREIGN PATENT DOCUMENTS

| | | | |
|---|---|---|---|
| 136784 | 3/1950 | Australia | 254/132 |

*Primary Examiner*—Robert C. Watson

*Attorney, Agent, or Firm*—David L. Baker; Rhodes & Ascolillo

[57] ABSTRACT

A hand operated post puller including a lever arm with multiple pivot points and a fulcrum mounted on a force dispersing foot. The cinch for the post is mounted on the end of the lever arm and consists of a pair of angulated links with a pair of separated bars mounted between them. The bars grip the post on either side and pressure from the lever arm tightens the cinch as the force pulls the post out of the ground.

4 Claims, 2 Drawing Sheets

HIGH SPEED MANUAL POST PULLER

BACKGROUND OF THE INVENTION

1. Field of the Invention

The invention relates to farm and garden tools and more particularly to a hand operated tool that extracts fence and other posts from their imbedded medium.

2. Description of the Prior Art

Farmers and gardeners have long found the need for fences to either keep things in or keep things out. Sooner or later most fences are removed for one reason or another and that requires removing the posts as well as rolling the wire or stacking the rails. Without the proper tools and equipment extracting fence posts, for example, can be a laborious and unpleasant chore.

Needless to point out that numerous systems and tools have been advanced to help reduce the energy expended and time required to remove posts. The systems offered thus far are either expensive, complicated or time consuming. Many of the tools attach as accessories to farm tractors which is acceptable unless the posts are located in woods or in irregular terrain where the tractor is unable to operate.

A number of U.S. Patents have been issued which exemplify the state of the art as known to Applicant including U.S. Pat. No. 3,525,502 issued Aug. 25, 1970 to Fisher who shows a post puller accessory that attaches to a tractor and is particularly adapted to pulling highway guardrail posts. The U.S. Patent issued on Dec. 27, 1983, U.S. Pat. No. 4,422,621 to Ekern is an adaptive apparatus for pulling fence posts that is ultimately connected to a hydraulic ram on a vehicle for motive power to actually pull the post. The post puller of Thompson as shown in U.S. Pat. No. 4,706,935 issued Nov. 17, 1987 is another tractor mounted apparatus, operating off the tractor's three point hitch. The U.S. Design Patent to Pollard, No. Des. 300,801 issued Apr. 25, 1989 is cited of interest in that it is entitled fence post puller however it's method of operation is obscure and not clearly defined. A U.S. Patent was issued to Ted P. Scott on Feb. 16, 1993 and numbered U.S. Pat. No. 5,186,437 which is a hand operated fulcrum design within the broad field of Applicant's invention but lacking in the fine points and unique design features of the instant invention.

SUMMARY OF THE INVENTION

The invention is directed to a post puller or extractor that is hand operated lever in the fulcrum design, with multiple pivot points and a single, simple to use post cinch which slips over the top of the post and grips the post without any need for further action by the user. A mating fulcrum point is used with the lever and designed to perform in difficult soils and difficult locations.

It is therefore an object of the invention to provide a new and improved post extractor.

It is another object of the invention to provide a new and improved post extractor that is quick and easy to use.

It is a further object of the invention to provide a new and improved post extractor that is easily operated by one person.

It is still another object of the invention to provide a new and improved post extractor that is low in cost and easily moved from place to place.

It is still a further object of the invention to provide a new and improved post extractor which has all the advantages of the prior art post pullers and none of the disadvantages.

It is another object of the invention to provide a new and improved post extractor which is of a durable and reliable construction.

It is another object of the invention to provide a post puller which may be easily and efficiently manufactured and marketed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and the objects other than those set forth above will become apparent when consideration is given to the following detailed description thereof. Such description makes reference to the annexed drawings wherein.

DETAILED DESCRIPTION OF A PREFERRED EMBODIMENT

Figure 2:
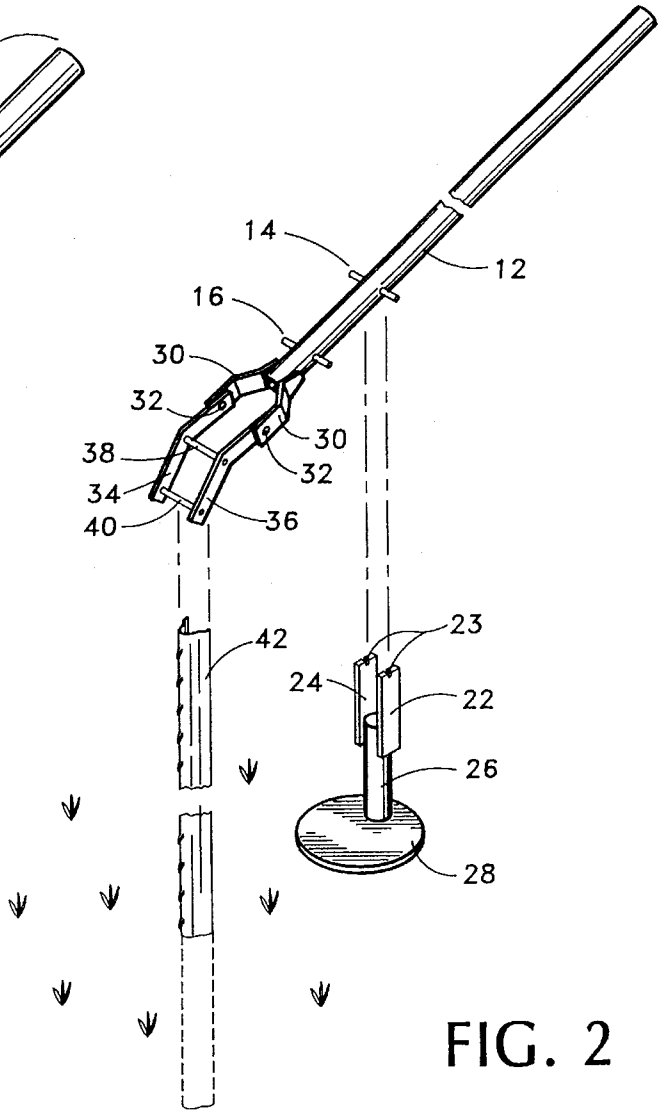
FIG. 2 is an environmental perspective view of the invention.
Figure 1:
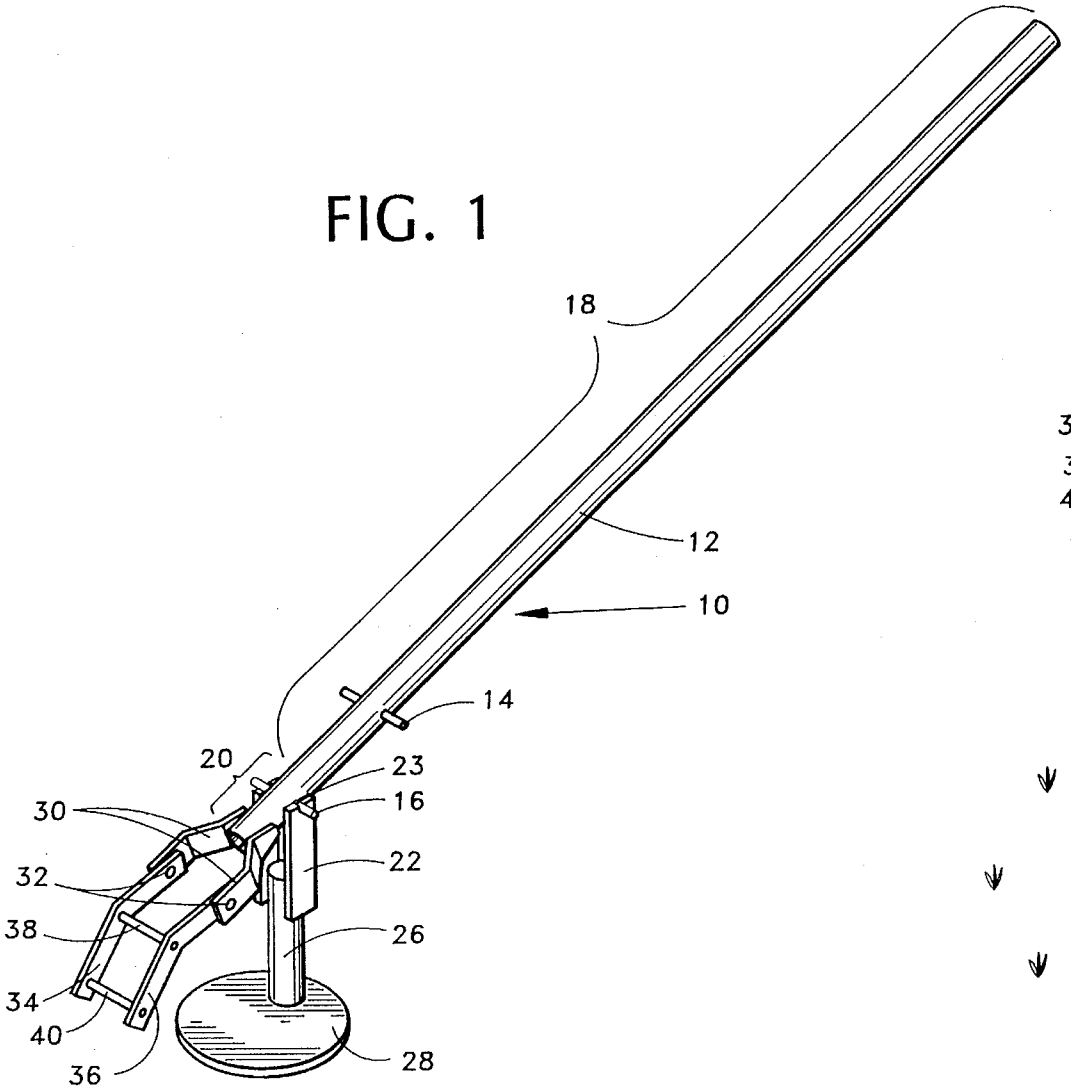
FIG. 1 is a perspective view of the invention.

Referring now to FIGS. 1 and 2, the invention is shown generally as 10. The lever arm 12 is formed of a suitable and appropriate material for the size of the work load and materials such as seel and wood generally fit this description. Pivot pins 14 and 16 are formed of harden material in that most of the force in pulling a post is applied at this point. The two spaced pivot points account for the differences in mechanical advantage applied to the lever as shown in FIG. 1 the maximum force is applied with a large movement of the long lever arm 18 but small movement in the short lever arm 20. The pivot pins rest in the slots 23 in the arms 22,24, which along with post 26 form a yoke mounted on the foot plate 28. A pair of arms 30 are attached to the end of lever arm 12 and turn out and away from the lever arm to a point 32 where the arms 34,36 from the cinch are pivotally attached. Gripper bars 38 and 40 join the arms 34, 36 and grip the post 42 as downward force is applied to the long lever arm.

Figure 3:
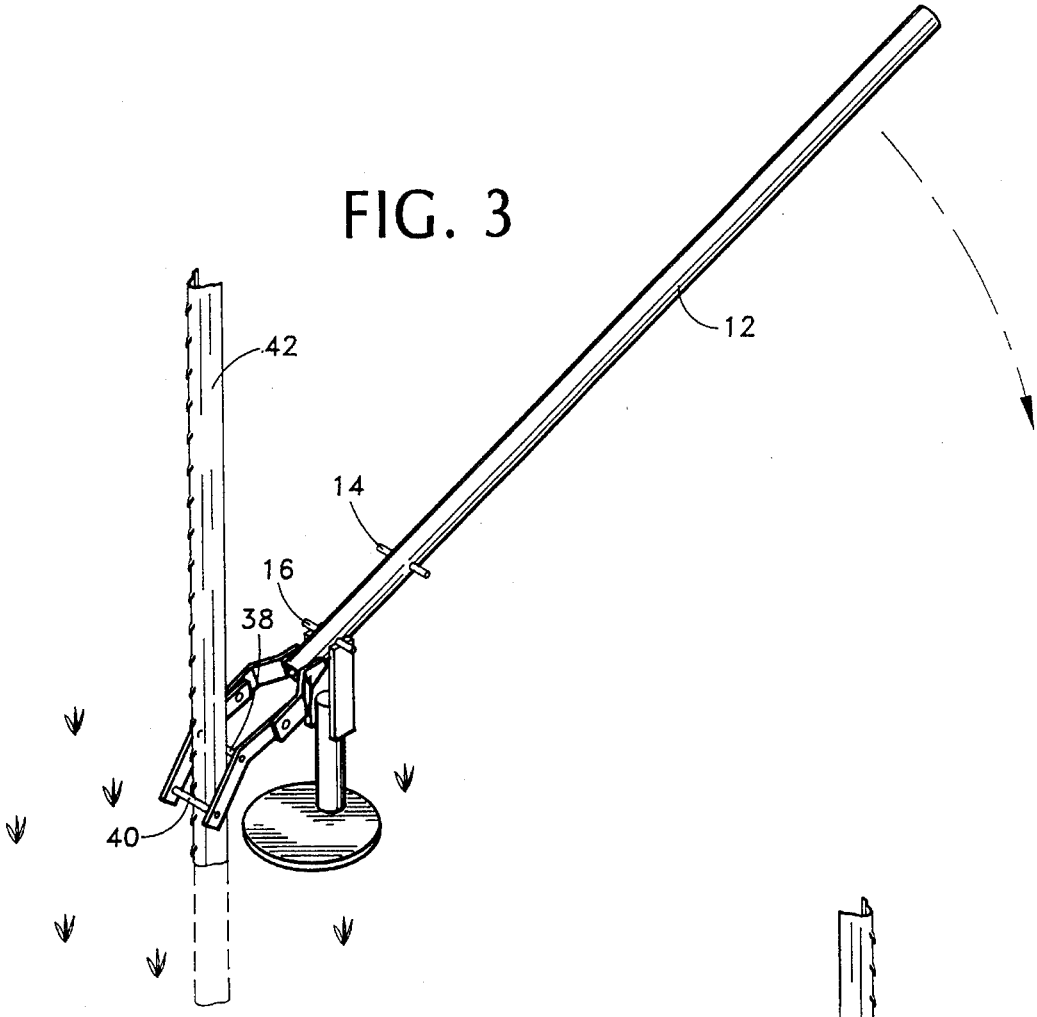
FIG. 3 is a right perspective view showing the cinch engaging a post in the ground.
Figure 4:
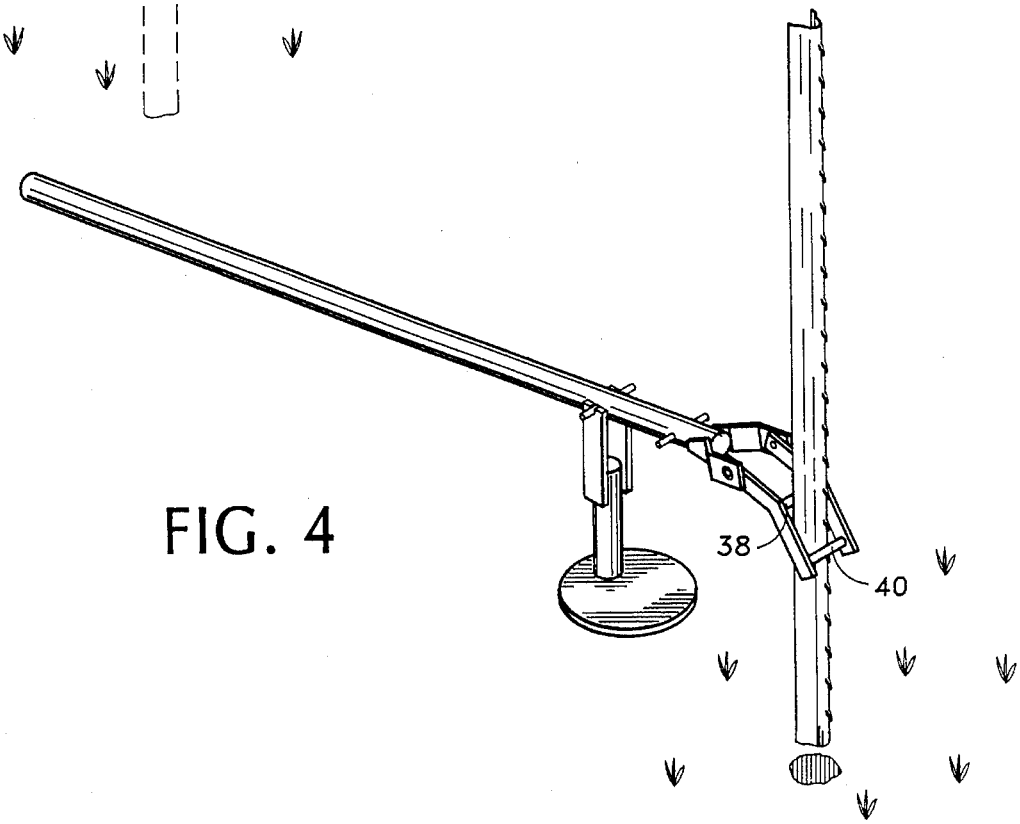
FIG. 4 is a left perspective view of the of the invention engaging a post removed from the ground.

Concerning FIGS. 3 and 4, with the gripper bars engaging the post, on opposite sides as shown and the yoke engaging the power pivot point 16, a downward force is applied to the long lever arm causing the post to loosen and begin to move. The pivot point is then moved to pin 14 where there is less multiplication of force but greater movement in the short lever arm. The post is then quickly and efficiently withdrawn from the imbedded material, the gripper bars disengaged and the post is free to be stacked, stored or left in place. The removal of steel fence posts is routinely only a matter of seconds, larger posts taking slightly longer. Posts up to three and one half inches may be removed with the invention.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A device for pulling posts imbedded in a natural medium comprising:

a lever arm;

pivot means located proximate one end of the lever arm;

yoke means for removably receiving the pivot means;

a foot plate, mounted on the yoke at a point off-center of the foot plate, for supporting the yoke;

a pair of arm means fixed to the lever arm in juxtaposition with the end of the lever arm, proximate the pivot means;

a pair of angulated links, one pivotally attached to each of said pair of arms;

a pair of gripper means fixed between said links in a spaced relation, whereby one said gripper means acts on one surface of a post and the other gripper means acts on the opposed side of the post and force applied to the lever arm causes said gripper means to apply force to the pose and move it in the direction of the applied force; and a second pair of pivot means located on the lever arm, spaced apart from the first pair of pivot means.

2. A device for pulling posts according to claim 1 wherein: said gripper means are steel bars.

3. A device for pulling posts imbedded in a natural medium comprising:

a lever arm;

pivot means located proximate one end of the lever arm;

yoke means for removably receiving the pivot means;

a foot plate, mounted on the yoke at a point off-center of the foot plate, for supporting the yoke;

a pair of arm means fixed to the lever arm in juxtaposition with the end of the lever arm, proximate the pivot means;

a pair of angulated links, one pivotally attached to each of said pair of arms;

a pair of gripper means fixed between said links in a spaced relation, whereby one said gripper means acts on one surface of a post and the other gripper means acts on the opposed side of the post and force applied to the lever arm causes said gripper means to apply force to the pose and move it in the direction of the applied force;

a second pair of pivot means located on the lever arm, spaced apart from the first pair of pivot means; and a first gripper bar is positioned between the links at a point of angulation of the links.

4. A device for pulling posts according to claim 3 wherein the second gripper bar is positioned between the links at a point proximate the distal end of the links.

* * * * *